US006044759A

United States Patent [19]

Bill

[11] Patent Number: 6,044,759

[45] Date of Patent: Apr. 4, 2000

[54] SCREEN REGISTRATION DEVICE

[76] Inventor: Ralph J. Bill, 17622 Wrightwood La., Huntington Beach, Calif. 92649

[21] Appl. No.: 09/039,286

[22] Filed: Mar. 13, 1998

[51] Int. Cl.[7] ..... B41L 13/02; B05C 17/08

[52] U.S. Cl. ..... 101/127.1; 101/126

[58] Field of Search ..... 101/126, 127, 101/127.1, 128, 128.1, 128.21

[56] References Cited

U.S. PATENT DOCUMENTS

| | | | |
|---|---|---|---|
| 2,438,639 | 3/1948 | Lawrence | 101/126 |
| 2,943,565 | 7/1960 | Malek | 101/127.1 |
| 5,775,221 | 7/1998 | Bill | 101/127.1 |

*Primary Examiner*—John S. Hilten
*Assistant Examiner*—Amanda B. Sandusky
*Attorney, Agent, or Firm*—James G. O'Neill

[57] ABSTRACT

A registration system for aligning a printing screen frame with an image platform includes a plurality of arms, rotatably secured to a lower surface of the image platform. The rotatable arms have retractable registration elements mounted on the outer ends thereof, and have inner ends which are mounted so as to be translated outwardly from and towards the lower surface of the image platform upon rotation of the arms, between retracted and registration positions. In the registration position, the registration elements are aligned with and cooperate with the printing screen frame to accurately align the printing screen frame over the image platform.

19 Claims, 6 Drawing Sheets

SCREEN REGISTRATION DEVICE

BACKGROUND OF THE INVENTION

1. Field of the Invention

This invention relates generally to screen printing and, more particularly, to an improved retractable registration system for aligning screen printing frames in a printing machine.

2. Description of the Prior Art

Many types of materials and products may be printed utilizing screen printing operations. Such screen printing operations may involve the printing of intricate designs utilizing a number of colors, requiring a high degree of precision. The use of more than one color results in the use of a number of screens, one for each color, with each screen being associated with an image in that color. It is necessary to ensure that the images for each screen are properly aligned so that when printed, the associated colors are aligned properly and that the final image is of high quality. Therefore, to provide the necessary precision in known printing machines, various types of registration systems are used to align each screen in registration to the platform on which an item is to be printed. This has become increasingly more important because of the multiple short runs printed on today's machines. Furthermore, since many types of items or materials are printed, such as caps, jackets, shirts, shorts, posters, etc., each bearing multi-colored designs printed in small quantities, there exists the need in the art for an accurate printing registration system, which may be easily and quickly used.

U.S. Pat. No. 5,503,068 to Newman discloses a retractable pallet attachment for screen printing. The system uses a pair of arms extending along longitudinal axes under an image platform. The arms have at least two cross sections, one of which is square and held in a mounting bracket. The mounting brackets are secured to the lower surface of the image platform, and the arms are movable in the mounting brackets to be extended outwardly from underneath the image platform. Each arm includes a finger extending therefrom, with at least one registration pin thereon for registration with an opening, or the like, in a screen frame. In the extended position, the arms are rotated to bring the fingers into a position 90° from their rest position, for cooperation with the respective opening in a screen frame. The movable arms include a first detent means for retaining the arms in a retracted position, and a second, separate detent means for retaining the arms in exact registration positions for aligning the same with the openings in the screen frame. Although this attachment solves many problems, it tends to be complicated, includes a large number of moving parts, and requires separate components to allow the arms to be moved or translated in a first direction, and further means whereby the fingers and registration pins may be rotated into and out of their operating positions when in the registration position. Furthermore, the first and second detent means for retaining the arms in the different positions require numerous parts, adding further costs and complexity to the attachment.

U.S. Pat. No. 5,377,422 to Newman discloses a roller frame having alignment brackets with a hole and a slot formed therein for registration with a pair of pins to align the roller frame. This roller frame may be used with the pin registration means set forth in U.S. Pat. No. 5,503,068, discussed above.

Other registration systems for use with screen printing are set forth in U.S. Pat. Nos. 4,911,070 to Miske, 4,938,130 to Thorpe, 4,993,166 to Bradely, 5,094,160 to Jennings, 5,094,161 to Taylor, 5,188,026 to Fuqua et al., and 5,226,366 to Schlife. Each of these patents disclose various positioning means for use in aligning printing screens in a printing machine. However, none of these devices disclose a simple rotary-type registration system of the type set forth in the present application which may be easily and quickly moved into position, in a single motion, to aid in registration of sequential printing screen frames, or rotated, in a single motion, into a retracted position, out of the way under an image platform.

Therefore, although the registration systems disclosed and shown in the prior art, solve many of the problems with accurate printing of a workpiece on an image platform, and attempt to solve problems that occur because of the need to register multiple screens, there still exists a need in the art for a system that is more quickly and easily actuated, and which is easier and less expensive to make.

SUMMARY OF THE INVENTION

Accordingly, it is a general object of the present invention to provide an improved system for registering sequential printing screens. It is a more particular object of the present invention to provide an improved registration system. It is a further particular object of the present invention to provide an improved registration system for multiple printing screens having rotatable registration means carrying arms. It is a still further particular object of the present invention to provide an improved registration system having a plurality of arms which rotate out from under a printing platform into an operating position. It is still another particular object of the present invention to provide an improved registration system having retractable registration means mounted on rotatable arms. It is yet another particular object of the present invention to provide an improved registration system having a plurality of rotatable attachment arms with retractable registration means, such as blocks, end stops or pins mounted thereon, which attachment arms are movable between a retracted position, under a workpiece image platform, and an operating position, extended from, but in alignment with the image platform. And, it is yet a still further particular object of the present invention to provide an improved registration system, having rotatable arms which include ramp means incorporated therein to translate the arms as they are rotated from a retracted rest position to an extended operating position.

In accordance with one embodiment of the present invention, a retractable registration system for aligning multiple printing screen frames is carried on an image platform, having an upper surface and a lower surface. The lower surface rotatably carries a plurality of arms near one end thereof, and includes means therein which allow the arms to be rotated outwardly, away from under the image platform, while at the same time, translating the arms and registration means located at the outer ends of the arms, toward the image platform, and into a position where the registration means may be registered with a printing screen frame or a locator position on the frame. The registration means held at the outer end of each arm may be held in a retracted position, and may be operated so as to extend upwardly, away from the arms, for registration with the screen frame.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENT

The following description is provided to enable any person skilled in the art to make and use the invention, and sets forth the best modes contemplated by the inventor of carrying out his invention. Various modifications, however, will remain readily apparent to those skilled in the art, since the generic principles of the present invention have been defined herein, specifically to provide for a novel and improved registration system, having rotatable registration arms, with retractable registration means mounted on an outer end thereof, and an operating means mounted at the other end thereof. The arms are preferably attached to the bottom of an image platform to enable printing screen frames to be more positively aligned over the image platform in a simple, quicker and more accurate manner. The present invention allows sequential printing screen frames to be used to print a number of workpieces, in a minimum period of time, with no restrictions on the number of colors, or the image to be printed. The registration means may take any desired form, such as fixed or movable blocks, end stops or pins, and is described herein, without limiting the same, as a registration system.

Figure 1:
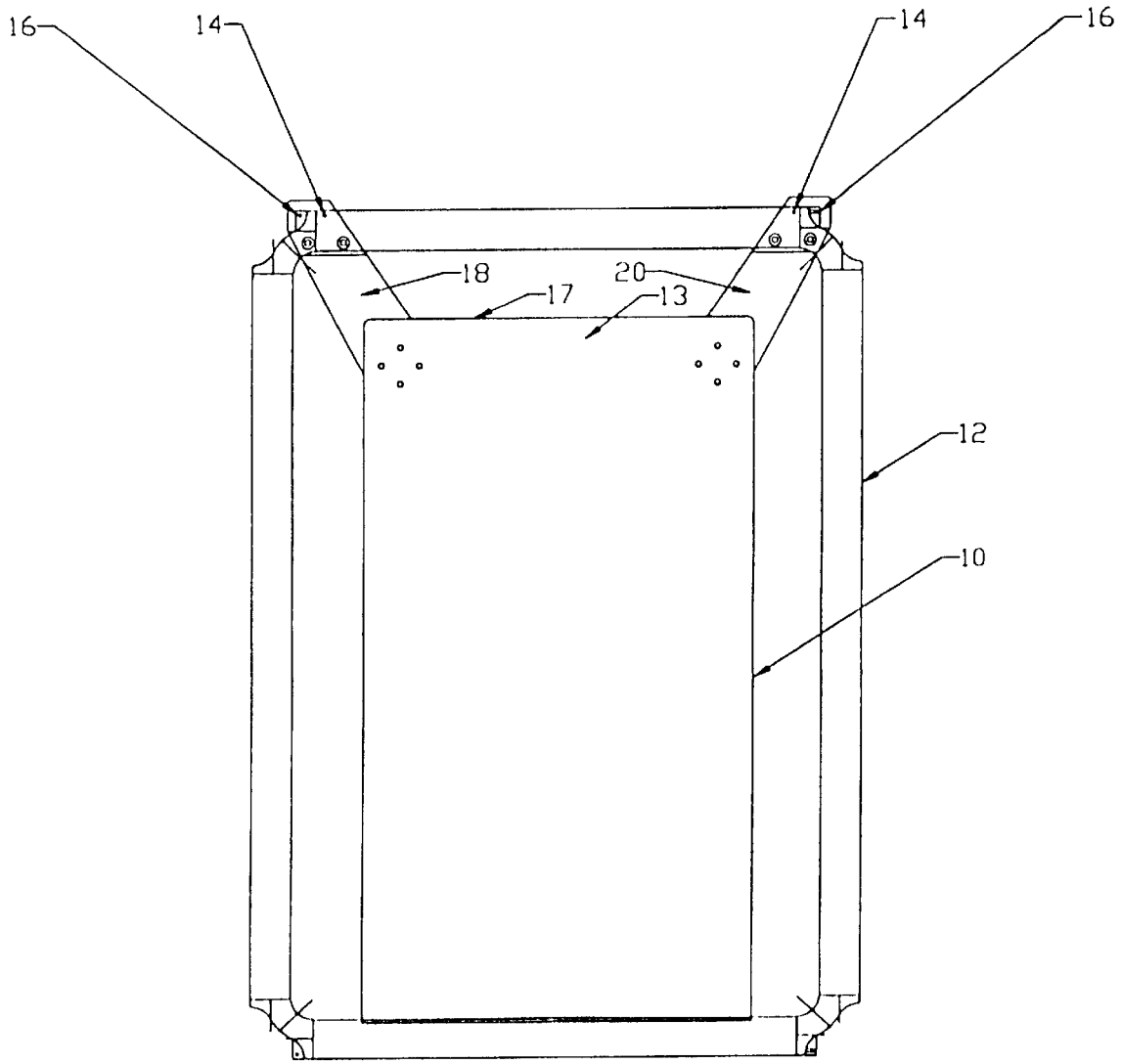
FIG. 1 is a top plan view of a preferred embodiment of an image platform, having a registration system of the present invention held thereon, with a roller-type screen frame mounted over the image platform, in a printing position, in registration with the registration system.

Turning now to the drawings, there shown in FIG. 1 is a printing image platform 10, such as a pallet or a platen for supporting a workpiece, such as a T-shirt, poster, etc., to be printed thereon by a screen held in a screen tensioning and printing frame 12, such as a roller frame of the type set forth in U.S. Pat. No. 5,377,422 to Newman, the disclosure of which is incorporated herein, in its entirety, by this reference thereto.

At one end of the screen frame 12, a pair of associated adapters, having a hole and a slot registration means, are included for registration with either of a pair of registration pins 14, 16, depending on the size or type of screen frame 12. The pins 14, 16 are movably supported at the outer ends of a plurality of registration arms 18, 20, which are in turn, rotatably mounted to the bottom or lower surface of image platform 10, as described more fully below.

Figure 2:
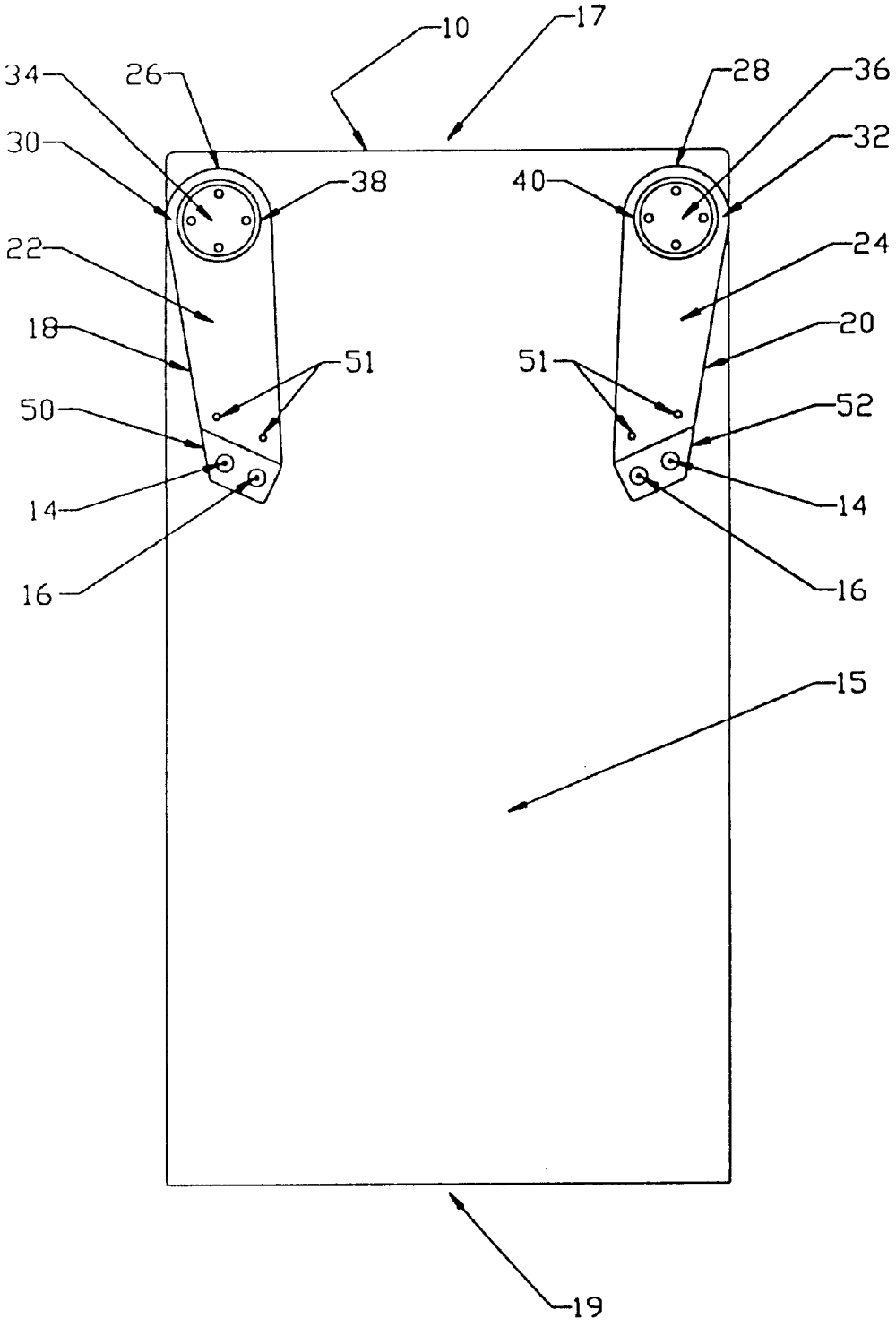
FIG. 2 is a bottom plan view of the image platform, with rotatable registration arms of the registration system in the retracted position, under and away from the image platform.
Figure 3:
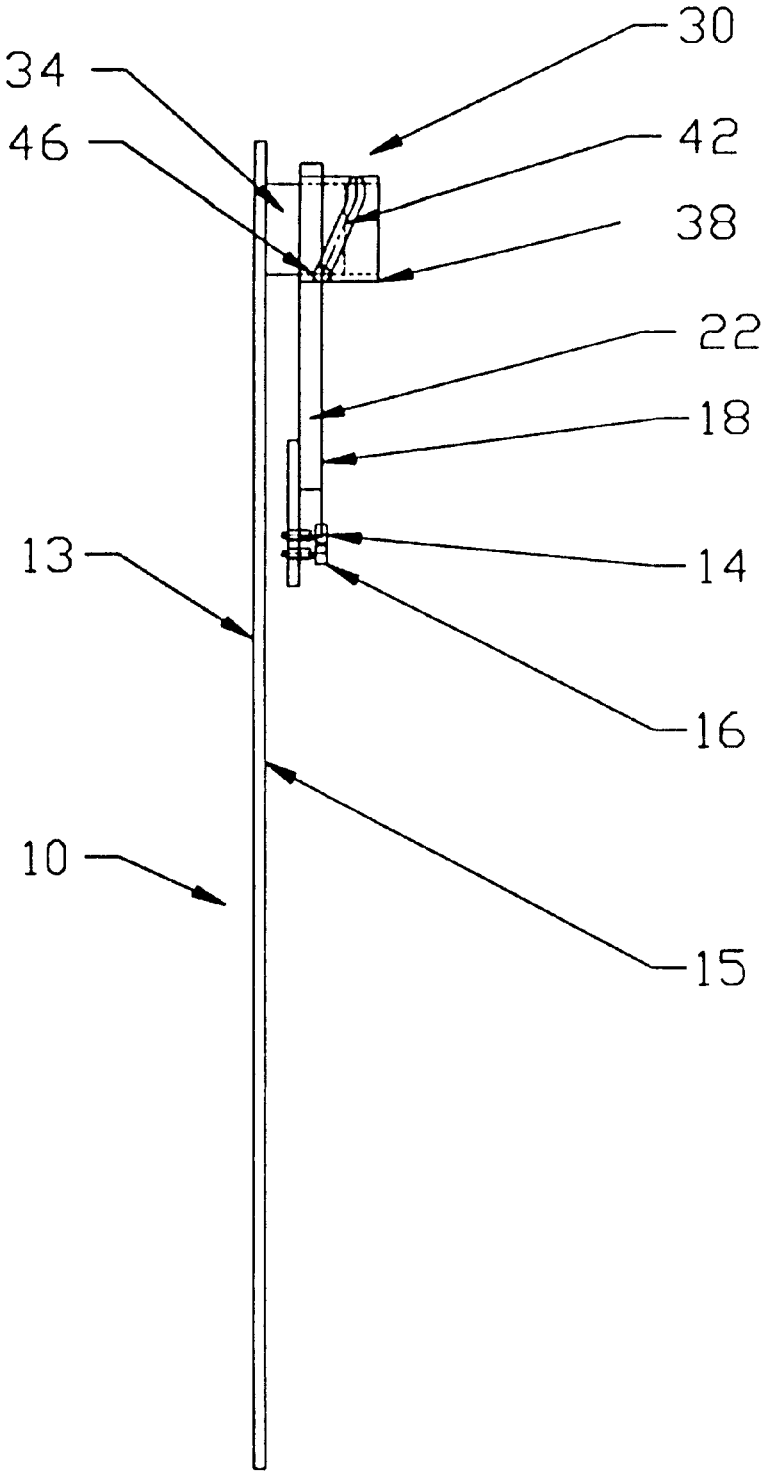
FIG. 3 is a side elevational view of FIG. 2.
Figure 4:
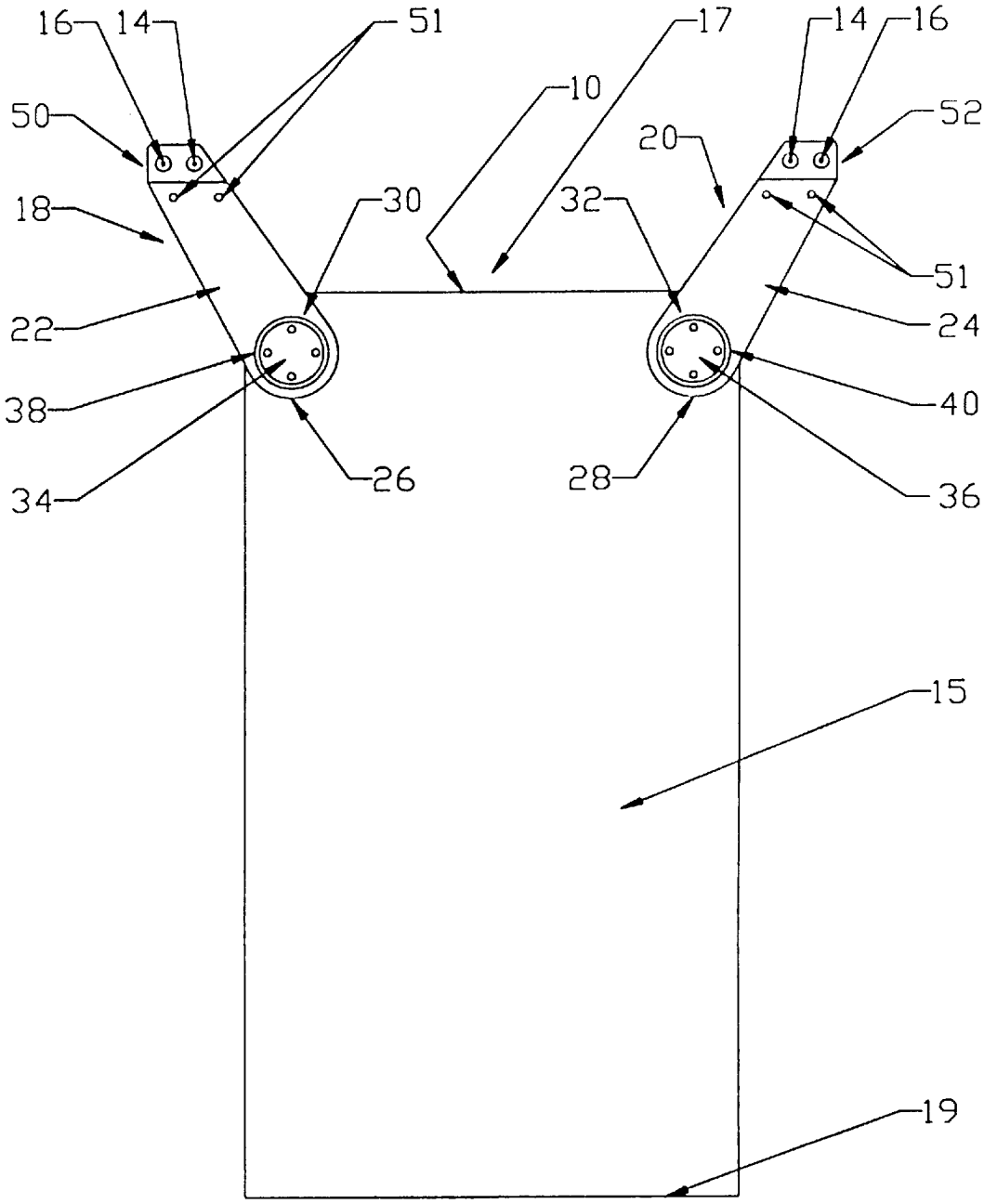
FIG. 4 is a bottom plan view, with the registration arms rotated outwardly and translated toward the image platform, into the registration position shown in FIG. 1.
Figure 5:
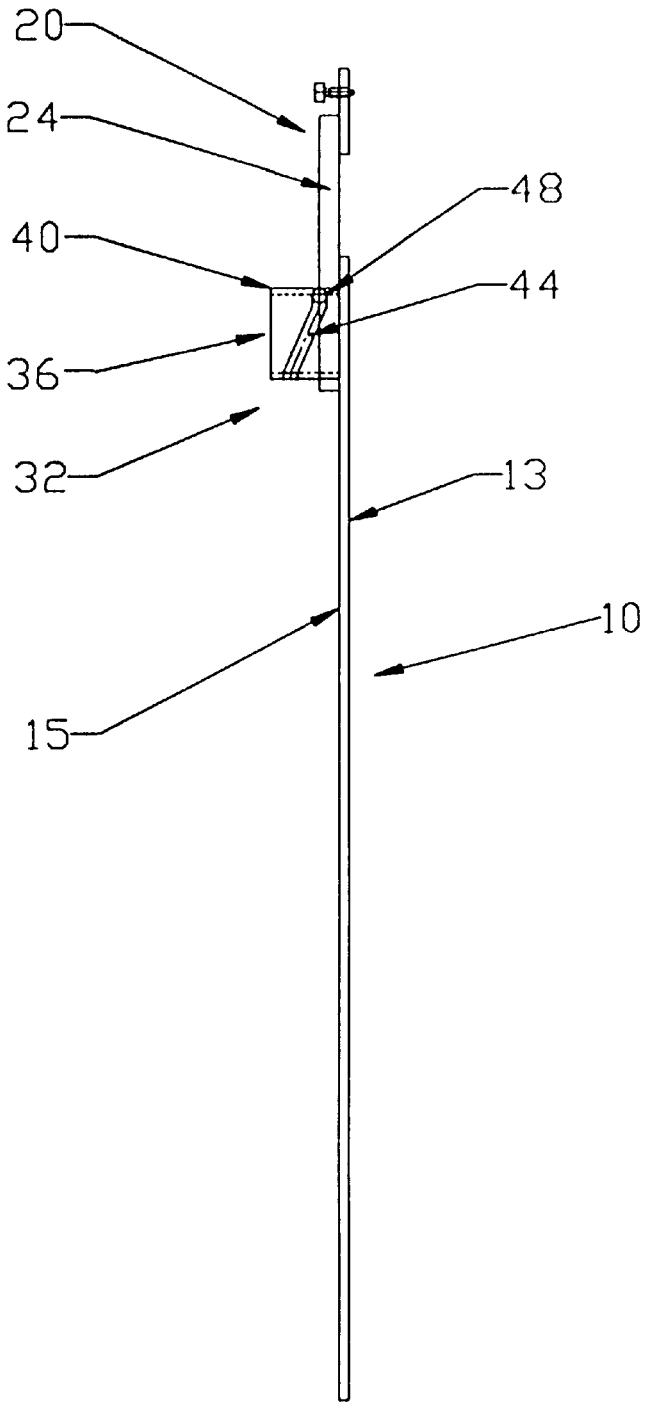
FIG. 5 is a side elevational view of FIG. 4.

Turning now to FIGS. 2 through 7, the operation of the rotatable arms 18 and 20, and the pairs of retractable registration pins 14, 16 will be described more fully. The image platform 10 includes an upper surface 13, a bottom or lower surface 15, a first end 17 and a second end 19. The arms 18, 20 are rotatably mounted, in any desired manner, to the lower surface 15, adjacent one end 17, at opposite corners thereof, as shown in FIGS. 2 and 3. The arms are rotatable between the closed or retracted position shown in FIGS. 2 and 3, to the extended or operating position, as shown in FIGS. 1, 4 and 5. There may be any required number, and such arms 18, 20 may take any desired shape, but are preferably formed as substantially elongated flattened members 22, 24, having first ends 26, 28, secured to or formed integrally with rotation and translation means 30, 32. Rotation and translation means 30 and 32 preferably take the form of a first or inner cylindrical means 34, 36 secured to the lower surface 15 and outer annular housings 38, 40, with one or more cam slots 42, 44 formed therein (see FIGS. 3, 5 and 7). Pin means 46, 48 are captured in the inner cylindrical means 34, 36, and are held in the cam slots 42, 44 so that upon rotation of the arms 18, 20, the annular, preferably cylindrical, housings 38, 40 will be rotated. For example, if the arms 18, 20 are rotated outwardly from a retracted position, under, but away from the bottom surface 15, as shown in FIGS. 2 and 3, to an operating position, at the same time, the arms are also moved vertically or translated closer to the bottom surface 15.

The other or outer ends of each of the flattened members 22, 24 have a further element 50, 52 secured thereto, as by securing means 51. Each of the further elements 50, 52 include a plurality of registration means, such as a pair of pins 14, 16, movably held therein, so as to be registrable with different sized print screen frames.

Each of further elements 50, 52 is preferably offset from members 22, 24 so that in the retracted position the pins 14, 16 held therein are substantially aligned with the bottom surfaces of members 22, 24, as shown in FIGS. 3 and 5. The pins 14, 16 are preferably the type which are hand retractable to a lowered position, as shown in FIGS. 3 and 5, away from the top surface of the outer elements 50, 52, and which may be turned or otherwise operated so as to selectively extend outwardly from the top surface of the elements 50, 52, and to cooperate or register with a hole or slot formed on frame 12.

Figure 6:
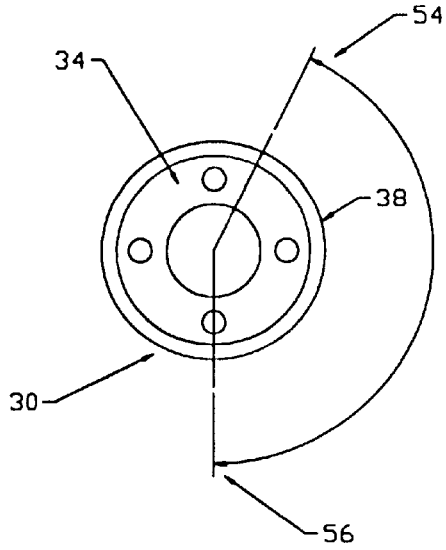
FIG. 6 is an enlarged top plan view of the rotation and translation mechanism of the arms of the present invention.
Figure 7:
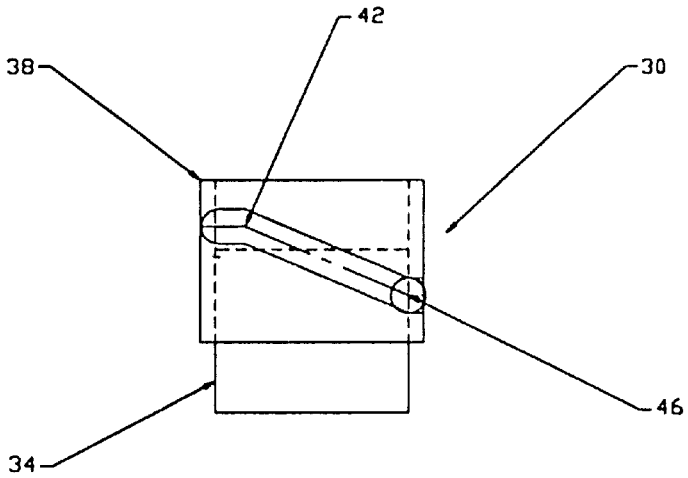
FIG. 7 is a side elevational view of FIG. 6.

The operation of the arms 18, 20 of the present invention will now be described, referring to FIGS. 3 and 5 through 7 of the drawings. As shown in more detail therein, the rotation and translation means 30, 32 consist of inner cylindrical means 34, 36 and outer annular or sleeve portions 38, 40, having one or more slanted or angled cam slots or tracks 42, 44 formed therein. Pins 46, 48 are held in the inner cylindrical means 34, 36 and cam slots 42, 44 for translational movement of arms 18, 20, upon rotation of the arms. For example, as shown in FIGS. 6 and 7, when the annular sleeve 38 of arm 18 is rotated outwardly from the position shown in FIG. 2, as indicated by arrowhead 56, in the direction indicated by arrowhead 54, the pin 46 will be moved along the ramp 42, to the position shown in FIG. 7. This rotation of the annular sleeve 38 with pin 46 therein moves the arm 18 vertically, toward the lower surface 15, as the arm 18 is rotated outwardly, away from the retracted position under the lower surface 15, to the angled operating position shown in FIG. 4. At the same time, upon rotation of arm 18 and annular housing 38, the pin 46, acting in cam slot 42, will move the arm 18 vertically, closer to the lower surface 15. The arm 20 is operated in the same manner. A selected one of the pins 14, 16 on each arm 18, 20, if in a retracted position, will be substantially level with the top surface 13, and may then be operated, as by being rotated, so that each pin will stick out or extend from the top surfaces of the pin holding means 50, 52 into a registration position.

Although the pin holding means 50, 52 are each shown as having a pair of pins 14, 16, it is to be understood that more pins or blocks or end stops could be used, if desired, depending on the size and type of frame 12 to be utilized therewith. The arms 18 and 20, and any registration means so used are sized and dimensioned, and spaced apart predetermined distances, so that when the arms 18, 20 are in the outward, operating position they will accurately cooperate or register with predetermined sized roller or other frames, to accurately align the frames over the image platform.

Thus, there has been described an improved and simplified registration system having rotatable registration arms with retractable pin or other registration means held in the outer ends thereof. The arms are mounted so that upon rotation, they will also be translated in a direction perpendicular to the rotation. In the retracted position, the arms are spaced a predetermined distance away from an image platform, while in the outwardly extending registration position, the arms are moved more closely to the image platform.

Those skilled in the art will appreciate that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. A retractable registration device for aligning a printing screen frame with an image platform, the device comprising:

a plurality of registration elements adapted to engage the printing screen frame;

a plurality of arms carrying the plurality of registration elements;

a cylindrical element secured to an inner end of each of the plurality of arms to enable each of the plurality of arms to rotate about an axis perpendicular to the image platform between a retracted position and a registration position;

the retracted position being underneath and removed from the bottom surface of the image platform, and the registration position being outwardly from underneath, but closer to the bottom surface of the image platform; and the cylindrical element, including a first rotational portion and a second portion for imparting translational movement to each of the plurality of arms, as the plurality of arms are rotated by the first rotational portion between the retracted position and the registration position.

2. The retractable registration device of claim 1 wherein the first rotational portion is mounted on the second portion.

3. The retractable registration device of claim 2 wherein the first rotational portion is an annular housing having at least one cam slot formed therein, and the second portion includes a pin held in the at least one cam slot.

4. The retractable registration device of claim 3 wherein each of the plurality of registration elements are movable between a lowered position in its respective arm and an engaging position, above a surface of its respective arm.

5. The retractable registration device of claim 4 wherein the second portion is secured to the bottom surface of the image platform.

6. The retractable registration device of claim 5 wherein the plurality of registration elements can be retracted, with respect to the plurality of arms, whereby, when retracted, the plurality of registration elements are substantially aligned with an upper surface of each of the plurality of arms.

7. The retractable registration device of claim 1 wherein each of the plurality of arms is comprised of a first member having two ends with the first rotational portion secured to a first end, and a second member secured to a second end and offset therefrom.

8. The retractable registration device of claim 7 wherein the second member includes at least one of said plurality of registration elements, movably secured therein.

9. The retractable registration device of claim 8 wherein the second portion is secured to the bottom surface of the image platform.

10. The retractable registration device of claim 9 wherein the first rotational portion includes an annular housing mounted over the second portion, and at least one cam slot is formed in the annular housing, and a pin is held in the second portion and extends into the at least one cam slot.

11. A retractable registration device for aligning a printing screen frame with an image platform, the device comprising:

a plurality of arms rotatably mounted to a lower surface of the image platform;

each of the plurality of arms having at least one registration element adapted to engage the printing screen frame;

a cylindrical housing secured to each of the plurality of arms for rotating about an axis perpendicular to the image platform and vertically moving each of the plurality of arms between a retracted position, under the lower surface of the image platform, and a registration position, outwardly, away from the lower surface of the image platform, and upwardly, in line with an upper surface of the image platform; and the cylindrical housing including a first cylindrical portion secured to the lower surface of the image platform.

12. The retractable registration device of claim 11, further including an annular housing rotatably mounted over the first cylindrical portion, and at least one cam slot having a pin held therein, formed in the annular housing.

13. The retractable registration device of claim 12 wherein each of the plurality of arms is comprised of a first member having a first end and a second end, and a second member secured to the first member at the second end thereof, and offset therefrom; the first end of the first member being secured to the annular housing, and the second member carrying the plurality of registration elements therein.

14. The retractable registration device of claim 13 wherein the plurality of registration elements carried in the second member can be held in a retracted position, which retracted position is substantially aligned with an upper surface of the second member.

15. The retractable registration device of claim 14 wherein there are two registration elements carried in each of the second members, and each of the registration elements is operable between the retracted position and an extended, registration position.

16. A retractable registration device for aligning a printing screen frame with an image platform, having two ends, an upper surface and a lower surface; the device comprising:

two arms rotatably mounted to the lower surface of the image platform, adjacent one of the two ends;

each of the two arms being formed from a first larger member having a first end and a second end, and a second smaller member, secured to the first larger member at the second end;

a plurality of registration elements secured to the second smaller member on each of the two arms, and each of the plurality of registration elements adapted to engage corresponding holding portions in the printing screen frame; and combined rotation and translation elements secured to the second end of each of the first larger members for imparting rotational movement about an axis perpendicular to the image platform and translational movement to each of the two arms; the combined rotation and translational elements comprised of a cylindrical housing secured to the lower surface of the image platform and an annular housing having a cam slot therein surrounding the cylindrical housing, and a cam pin secured in the cylindrical housing and held in the cam slot.

17. The retractable registration device of claim 16 wherein the plurality of registration elements are movable pins.

18. The retractable registration device of claim 17 wherein the movable pins are retractable into the two arms.

19. The retractable registration device of claim 18 wherein the movable pins are movable between retracted and extended positions, and may be captured and held in the retracted and extended positions.

* * * * *